United States Patent [19]

Klein

[11] 4,224,978

[45] Sep. 30, 1980

[54] METHOD OF MANUFACTURING COMPOSITE STRIPS BY CONTINUOUS CASTING

[75] Inventor: Dominique Klein, Ham, France

[73] Assignee: Manufacture Metallurgique de Tournus, Tournus, France

[21] Appl. No.: 45,085

[22] Filed: Jun. 4, 1979

[30] Foreign Application Priority Data

Jun. 19, 1978 [FR] France ..... 78 18926

[51] Int. Cl.[3] ..... B22D 11/06; B22D 19/00

[52] U.S. Cl. ..... 164/86; 164/419

[58] Field of Search ..... 164/86, 419, 428

[56] References Cited

FOREIGN PATENT DOCUMENTS 1364758 5/1964 France ..... 164/86

*Primary Examiner*—Robert D. Baldwin

*Attorney, Agent, or Firm*—Dennison, Dennison, Meserole & Pollack

[57] ABSTRACT

A method of plating a strip of a metal having a melting point and a mechanical resistance which are higher than those of aluminum. The metal strip which is to be plated onto the aluminum strip is interposed between the roll or rolls and the aluminum strip on at least one face of an aluminum strip by continuous casting between rolls and by use of a nozzle. The strip of plating metal contacts the roll at least over the portion between the generatrix closest to the end of the nozzle and the generatrix situated in the plane of the roll axes. The clearance between the nozzle and the plating metal strip applied to the roll is less than 1 mm and the elongation of the plating metal strip is greater than 1% and less than that of the solidified aluminum. The present method is used in the production of composite aluminum-copper or aluminum-stainless steel strips.

7 Claims, 2 Drawing Figures

METHOD OF MANUFACTURING COMPOSITE STRIPS BY CONTINUOUS CASTING

BACKGROUND OF THE INVENTION

1. Field of the Invention

The present invention relates to a method of producing composite strips composed of an aluminum core coated on one face or on both faces with a metal having a melting point and mechanical strength which are substantially higher than those of aluminum by casting the aluminum continuously between rolls and interposing a metal plating strip between the work roll or rolls and the aluminum. The invention also relates to the composite strips obtained by such a method.

2. Description of the Prior Art

French Pat. No. 1,364,758, granted on 19th May, 1964, describes in principle a continuous casting method in which the still liquid metal is introduced between two cooled rolls and in which a metal plating strip is interposed between this liquid metal and the work rolls, this metal plating strip being entrained continuously with the rolled metal and thus being plated onto it. The purpose of this process was essentially to plate an aluminum blank, whose surface exhibited a fairly coarse texture due to the small amount of working, with a strip of aluminum having an improved resistance to corrosion and a surface condition which is of better quality or which is more suitable, in particular, for anodic oxidation treatment or polishing treatment. However, the information given in said patent does not allow plating to be performed with a metal having properties which are quite different from those of aluminum, for example, plating with stainless steel to give sufficient adhesion for the composite strip subsequently to be transformed.

Various methods for the continuous casting of aluminum between rolls are also known. For example, French Pat. No. 1,198,006 granted on 8th June, 1959, as well as its Certificate of Addition No. 74839, describe a device comprising a supply tank which receives the molten metal from a casting furnace and a nozzle having a flattened profile which is intended to distribute the metal over a strip of given width. The end of the nozzle is fitted between two parallel rolls which are spaced apart. The molten metal leaving the nozzle cools and solidifies upon contact with the cooled rolls and is entrained in the form of a strip which is subjected to a certain pressure, due to the curvature of the rolls. Once it has reached the plane of the roll axes, the strip is wound onto a winder. That method permits the production of aluminum strips in a range of thicknesses of from 1.5 mm to 20 mm thick in an economical manner. The prior processes do not provide composites producable according to the present invention.

SUMMARY OF THE INVENTION

The present invention provides a method of continuous casting which produces, at the outlet of rolls, plated strips containing a core of aluminum or aluminum alloy which is between 1.5 mm and 20 mm thick and a plating on one or both faces of the aluminum core a metal having a melting point and a mechanical strength which are substantially higher than those of aluminum, the plating of metal being between 0.1 and 1 mm thick so as to obtain excellent adhesion of the aluminum to metal plating. The invention allows composite strips to be formed which are able to withstand subsequent transformation, for example by stamping, under good conditions, the production cost of these strips being very competitive relative to other plating methods.

The process according to the invention involves the combination of the following process parameters:

(a) the strip of plating metal is in contact with the roll at least over the portion comprised between the generatrix closest to the end of the nozzle and the plane of the roll axes and, preferably, over an arc of contact which is greater than 30°;

(b) the clearance between the nozzle and the roll entraining the plating metal does not exceed the thickness of the plating strip by more than 1 mm; and, (c) the casting speed is such that the elongation of the plating metal is greater than 1% while remaining lower than that of the aluminum once it has solidified.

The plating metal can be, for example, copper or stainless steel. In the case of stainless steel, the elongation of the strip is preferably between 3 and 10%. The applicants have observed, furthermore, that a special metallurgical structure of the layer of solidified aluminum leaving the rolls could be combined with the specific casting conditions to insure excellent adhesion of the plating metal strip to the aluminum. In fact, this aluminum layer exhibits, under these conditions, in a longitudinal section, herringbone-shaped solidified dendrites which are oriented in the opposite direction to the advance of the metal flow, the average direction forming an angle of less than 85° and preferably less than 75° with the plane of the strip. This structure appears very clearly, when, for example, the surface of the section is treated with a conventional reagent for macrography. When plating of the same type and of the same thickness is performed on the two faces of the strip, it goes without saying that the conditions of thermal exchange between the strip and the two rolls are almost identical. In this case, the dendrites are therefore approximately symmetrical relative to the median plane of the layer of aluminum. This is obviously not the case when plating is only performed on a single face. In this case, the alignment of the peaks of the dendrites no longer coincides with the median plane but is shifted toward the plated face.

It has been observed that, under the casting conditions defined above and leading to good adhesion of the components, the shifting relative to the median plane should not exceed 10% of half the thickness of the layer of aluminum.

The objects of the invention thus referred to will be more readily appreciated and comprehended in light of the following detailed description of the preferred embodiments.

DESCRIPTION OF THE PREFERRED EMBODIMENTS

Figure 1:
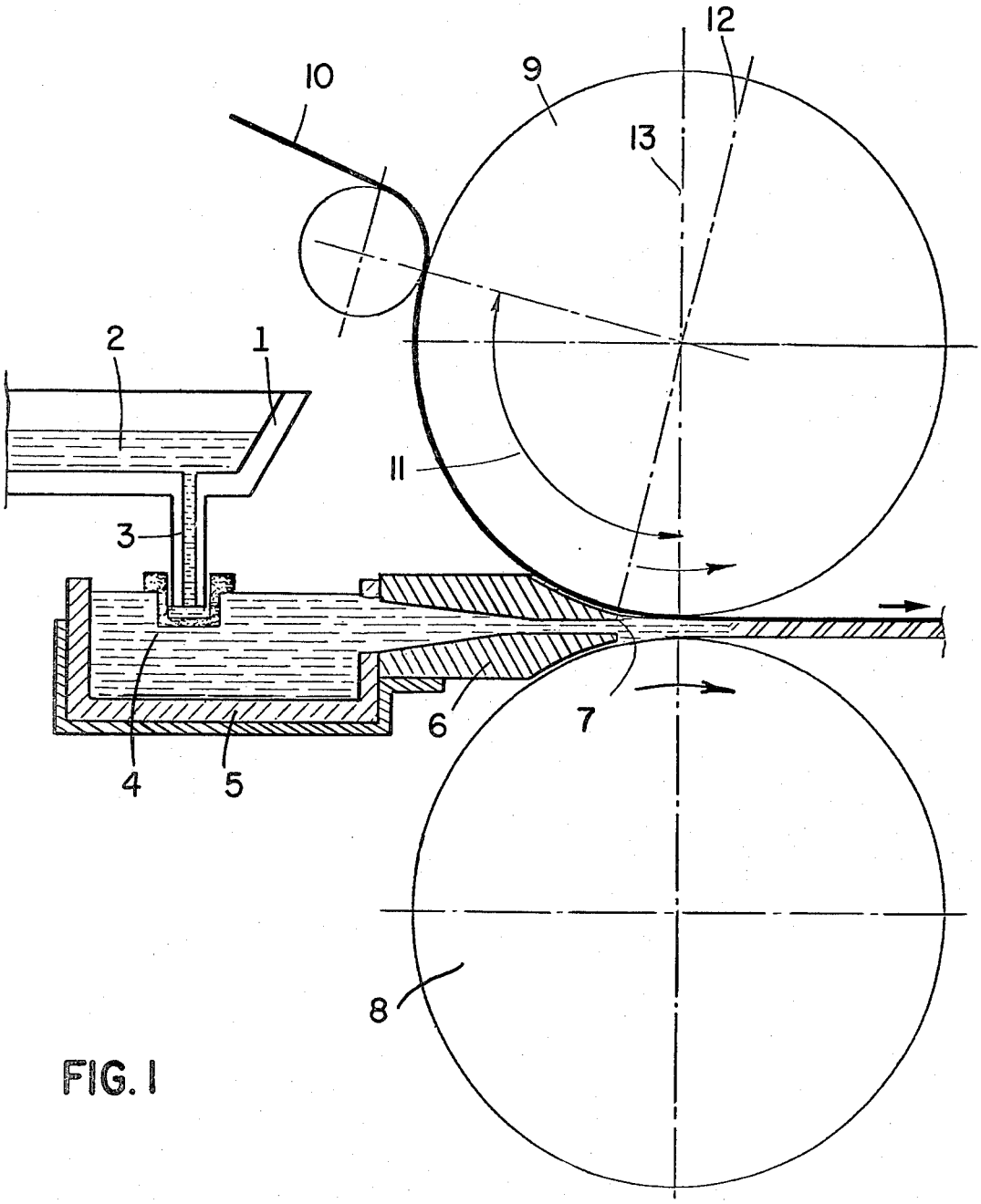
FIG. 1 is a diagrammatical representation of the continuous casting device utilized to produce a composite strip according to the method of the invention.

Referring now to the drawings and particularly to FIG. 1, a casting device is seen to be comprised of a chute 1 containing liquid aluminum 2. The chute 1 is provided with an outlet 3 and a float 4 which allows a constant level of metal to be maintained in supply tank 5. The supply tank 5 communicates with a nozzle 6 having a tapered end which discharges the molten metal through outlet tube 7 between two rolls 8 and 9, the molten metal being discharged over a width which is equal to the desired width of the strip. A strip of plating metal 10 is unwound from a suitable storage reel (not shown) so as to come into contact with the roll 9 with an arc of contact 11 which is at least equal to the arc comprised between generatrix 12 which is closest to the end of the nozzle and plane 13 of the roll axes. It is interesting that the arc of contact is sufficiently large to allow the plating strip 10 to be heated and the superficial moisture to be desorbed. It is to be understood that aluminum as described herein can be pure aluminum or an aluminum alloy.

The surface of the strip 10 is prepared by known methods such as degreasing, pickling, brushing, and/or abrasion in order to assist the plating operation. Thus, before it is brought into contact with the aluminum, the strip 10 can be previously degreased and abraded on the face which will be covered with aluminum, for example by brushing, to give a roughness of the order of 0.1 to several microns CLA approximately. It has been observed that it was desirable for the abrasion operation to take place just before plating rather than performing it in a preliminary operation. On the other hand, the other face in contact with the roll must preferably remain smooth so as not to impair the thermal exchange. The strip 10 can, of course, be subjected to a traction level of, for example, 5 to 100 MPa in order to obtain good contact with the roll 9. The clearance between the end of the nozzle 6 and the roll 9 covered with the strip 10 must be just sufficient to prevent too much friction which might damage the nozzle and to prevent lubricant from being scraped on the uncovered roll. This clearance must be limited to about 1 mm so as to prevent instability of the meniscus of alumina which forms in this clearance as this would be detrimental to adhesion. This clearance is limited by the pre-stressing of the stand of the casting rolling mill to a stress value which is close to the one obtained in operation which counterbalances the clearance caused by the yielding.

The aluminum gradually solidifies as it passes between the rolls 8 and 9. If the aluminum solidifies completely before leaving the rolls at a thickness E, it undergoes additional rolling which reduces its thickness to e. The reduction rate $(E-e/E)\times 100$ between the nozzle outlet and the roll outlet is generally between 10 and 40%. The plating strip 10 is rolled lightly as it passes between the rolls 8 and 9. One condition for obtaining correct plating is that the elongation of the plating strip 10 be greater than 1% while remaining smaller than the elongation of the aluminum between the end of solidification and the outlet of the rolls. A further process variable is the actual speed of advance. The theoretical maximum speed of continuous casting between rolls is the speed at which the foremost point of the solidification front is located close to the plane of the roll axes. In practice, a speed which is slightly slower than this theoretical speed is adopted when casting non-plated aluminum. When a plating strip 10 is introduced, it has been observed that, to obtain good plating, it was necessary to limit the speed more so as to maintain an adequate reduction rate of the base metal. If higher speeds are to be applied, it is observed that the plating strip 10 tends to fold, particularly when it is thin, probably because this strip is applied to the roll less well as the aluminum is only solidified in the vicinity of the median plane.

The composite strip is cooled at the outlet of the rolls using merely air. Contrary to the teaching of French Pat. No. 1,364,758, when plating stainless steel, and owing to the different coefficients of expansion of aluminum and steel, it is not worth cooling the strip rapidly as this would increase the stresses at the interface between the two metals. On the contrary, it is better for the cooling to be slow at a temperature ranging from approximately 250° C. to 450° C. so that the expansions are resorbed by the creep of the aluminum. This may be performed without the risk of any brittle intermetallic phases appearing because the temperature is within a zone where these phases have little chance of forming rapidly. Cooling must be faster initially if the plating metal is a copper alloy.

It is advantageous to perform a rolling pass after cooling the strip as this permits the adhesion of the plating to be improved and allows the properties of wrought metal, which are generally better than those of foundry metal, to be imparted to the aluminum. It is obviously not worth cold working the plating metal to a significant degree if the composite strip is subsequently to be transformed, for example by stamping. However, as the method allows fairly thin composite strips between 1.5 and 6 mm thick to be obtained, unlike the methods of the prior art, the cast strip can be used without subsequent rolling.

A method of plating a strip onto one face of the cast aluminum which is plated on both faces is to be obtained, a metallic strip is unwound onto the roll 8 under the same conditions as the strip 10 is unwound onto the roll 9. In this case, the casting speed is slightly slower than it would be for plating on only one face. This method can be applied whatever the inclination of the roll axis to the vertical.

Figure 2:
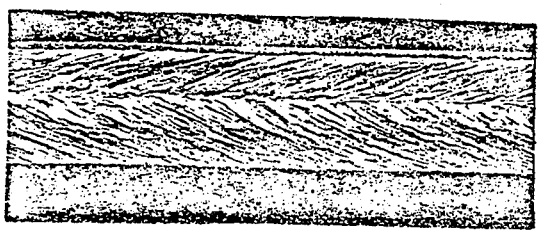
FIG. 2 is an idealized longitudinal sectional view of a composite strip with plating on one face to reveal the solidified dendrites.

FIG. 2 shows the appearance of a longitudinal section of a composite aluminum-stainless steel strip after it has been pickled in a macrographic fluochloronitric reagent. Herringbone shaped solidified dendrites are seen to appear in the layer of aluminum, the average direction of which forms an angle of less than 75° with the median plane of the strip. Owing to the asymmetry of the covering, the line of the peaks of the dendrites is shifted slightly from the side of the plating, but with an eccentricity of less than 20%.

The process according to the invention allows composite aluminum-metal strips to be obtained with a metal having a melting point and a mechanical strength which are substantially higher than those of aluminum and, more particularly, aluminum-copper or aluminum-stainless steel composite strips which can be used, in particular, for the production of kitchen utensils or heat exchangers under particularly attractive economic conditions. The adhesion between the components is excellent.

The invention will also be illustrated by non-limiting embodiments as described hereinafter.

EXAMPLE I

A strip of 0.3 mm thick austenitic stainless steel designated as Al Sl 304 is plated onto 10 mm thick 1050 aluminum by continuous casting between 600 mm diameter rolls. Once the strip has been degreased, it is brushed with a wire brush so as to obtain a roughness of the order of 1 micron CLA, and is then placed in the gap of about 1 mm between the roll and the end of the aluminum feed nozzle. The stainless steel strip surrounds the roll at an angle of about 90°. During the plating operation, the stainless steel strip is elongated by about 8%. The solidified ridge of aluminum is off-centered by about 5%, and the angle of the dendrites is about 15° to the median plane. The adhesion of the products obtained is good.

EXAMPLE II

A strip of 0.4 mm thick Al Sl 434 ferritic stainless steel is plated onto 2.6 mm thick 1050 aluminum by continuous casting between 600 mm diameter rolls. Once the stainless steel strip has been degreased, it is brushed with a wire brush so as to obtain a roughness of the order of 1 micron CLA and is then placed in the gap of about 0.6 mm between the roll and the end of the aluminum feed nozzle. The stainless steel sheet surrounds the roll at an angle of about 90°. The stainless steel sheet is elongated by about 3% during the plating operation. The solidified ridge of aluminum is off-centered by about 5%; the angle of the dendrites is 60° to the median plane. The adhesion of the products obtained is good. The product can be stamped after cold rolling with a reduction of 30%.

EXAMPLE III

A strip of 0.5 mm thick copper is plated onto 6 mm thick 1050 aluminum by continuous casting between 600 mm diameter rolls. Once the strip has been degreased, the copper is brushed with a wire brush so as to obtain a roughness of 1.5 microns CLA, and is then placed in the gap of about 1 mm between the roll and the end of the aluminum feed nozzle. The strip of copper surrounds the roll at an angle of about 30°. The strip of copper is elongated by about 10.5% during the plating operation. The solidified ridge of aluminum is off-centered by about 1%; the angle of the dendrites is of the order of 30°. The adhesion of the composite obtained allows further cold-rolling by successive passes to a thickness of 3.25 mm, that is to say a reduction rate of 45%.

While explicit embodiments of the invention have been described herein, it is to be understood that the invention can be practiced other than as particularly described. Accordingly, the scope of the invention is to be limited only by the definition provided by the appended claims.

I claim:

1. A method of forming a composite material formed of a strip which is between 0.1 and 1 mm thick of a metal having a mechanical strength and melting point which are substantially higher than those of aluminum, the strip being plated on at least one face of a strip of the aluminum which is between 1.5 and 20 mm thick by continuous casting of the aluminum between spaced parallel rolls, the aluminum being discharged between the rolls by means of a nozzle having a flattened cross-section and a width equal to the strip to be cast which is placed in the vicinity of the rolls, the metal strip to be plated onto the aluminum strip being interposed between the roll or rolls and the aluminum, comprising the steps of:

contacting the strip of plating metal with one of the rolls over an arc of contact which is greater than 30° and includes the portion thereof between a generatrix closest to the end of the nozzle and a generatrix situated in the plane of the roll axes;

providing a clearance between the nozzle and the roll entraining the plating metal of a dimension smaller than the thickness of the plating strip increased by 1 mm; and, providing a casting speed such that the elongation of the plating metal strip is greater than 1% and less than that of the aluminum once the aluminum has solidified.

2. A method according to claim 1 and further comprising the step of abrading the plating metal strip on a face thereof which is to adhere to the aluminum prior to contact of the plating metal strip with the aluminum.

3. A method according to claim 2 wherein the plating metal strip is brushed immediately prior to casting.

4. A method according to claim 1 and further comprising the step of cold-rolling the composite strip after cooling.

5. A method according to claim 1 wherein the plating metal strip is a copper alloy.

6. A method according to claim 1 wherein the plating metal strip is stainless steel.

7. A method according to claim 6 wherein the elongation of the stainless steel between the casting rolls is between 3 and 10%.

* * * * *